US006638026B2

(12) United States Patent
Suitou et al.

(10) Patent No.: US 6,638,026 B2
(45) Date of Patent: Oct. 28, 2003

(54) CONTROL VALVE FOR VARIABLE DISPLACEMENT COMPRESSOR

(75) Inventors: Ken Suitou, Kariya (JP); Kazuya Kimura, Kariya (JP); Ryo Matsubara, Kariya (JP); Satoshi Umemura, Kariya (JP); Kazuhiko Minami, Kariya (JP); Masaki Ota, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/044,644

(22) Filed: Jan. 9, 2002

(65) Prior Publication Data

US 2002/0094279 A1 Jul. 18, 2002

(30) Foreign Application Priority Data

Jan. 12, 2001 (JP) ..... 2001-005037
Mar. 29, 2001 (JP) ..... 2001-096219

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3

(56) References Cited

U.S. PATENT DOCUMENTS 6,142,445 A * 11/2000 Kawaguchi et al. ... 251/129.15
6,196,808 B1 * 3/2001 Taguchi ..... 417/222.2
6,336,335 B2 * 1/2002 Ota et al. ..... 123/198 R
6,371,734 B1 * 4/2002 Ota et al. ..... 417/222.2
6,382,926 B2 * 5/2002 Ota et al. ..... 417/222.2
6,385,979 B2 * 5/2002 Ota et al. ..... 62/115
6,386,834 B1 * 5/2002 Kimura et al. ..... 417/222.2
2001/0002237 A1 * 5/2001 Ota et al. ..... 417/222.2
2001/0008131 A1 * 7/2001 Ota et al. ..... 123/339.17
2001/0013225 A1 * 8/2001 Ota et al. ..... 62/228.5
2001/0014287 A1 * 8/2001 Ota et al. ..... 417/213
2001/0027658 A1 * 10/2001 Ota et al. ..... 62/228.3
2001/0027659 A1 * 10/2001 Ota et al. ..... 62/228.3
2001/0052236 A1 * 12/2001 Ota et al. ..... 62/228.3
2001/0055531 A1 * 12/2001 Ota et al. ..... 417/222.2
2002/0011074 A1 * 1/2002 Suitou et al. ..... 62/228.3
2002/0031432 A1 * 3/2002 Ota et al. ..... 417/222.2
2002/0035842 A1 * 3/2002 Suitou et al. ..... 62/228.3
2002/0037223 A1 * 3/2002 Suitou et al. ..... 417/222.2
2002/0064467 A1 * 5/2002 Ota et al. ..... 417/222.2

FOREIGN PATENT DOCUMENTS

| | | |
|---|---|---|
| EP | 0 396 017 A2 | 11/1990 |
| EP | 0 748 937 A2 | 12/1996 |
| EP | 0 935 107 A2 | 8/1999 |
| EP | 1 052 405 A2 | 11/2000 |
| EP | 1 154 160 A2 | 11/2001 |
| JP | 6-213151 | 8/1994 |
| JP | 11-324930 | 11/1999 |
| JP | 0 985 823 A2 | 3/2000 |
| WO | WO 99/06700 A | 2/1999 |

* cited by examiner

*Primary Examiner*—Charles G. Freay
*Assistant Examiner*—William H. Rodriguez
(74) *Attorney, Agent, or Firm*—Morgan & Finnegan, LLP

(57) ABSTRACT

A control valve has a valve housing. A valve chamber and a pressure sensing chamber are defined in the valve housing, respectively. A pressure sensing member is located in the pressure sensing chamber. A pressure sensing rod is slidably supported by the valve housing. A valve body is accommodated in the valve chamber. An end of the pressure sensing rod is connected to the pressure sensing member and the other end of the pressure sensing rod contacts the valve body. A solenoid chamber is defined in the valve housing. A stationary iron core is located between the valve chamber and the solenoid chamber. A solenoid rod extends through and is slidably supported by the stationary iron core. An urging force applied to the pressure sensing member by an actuator through the solenoid rod corresponds to a target value of the pressure difference. The pressure sensing member moves the valve body such that the pressure difference seeks the target value.

12 Claims, 5 Drawing Sheets

CONTROL VALVE FOR VARIABLE DISPLACEMENT COMPRESSOR

BACKGROUND OF THE INVENTION

The present invention relates to a control valve for a variable displacement compressor that is used in a refrigerant circuit of a vehicle air conditioner.

FIG. 5 illustrates a part of a control valve disclosed in Japanese Unexamined Patent Publication No. 11-324930. In this control valve, two pressure monitoring points P1, P2 are located in a refrigerant circuit. The pressure difference between the two points monitoring P1, P2 is mechanically detected by a pressure sensing member 101. The position of a valve body 102 is determined in accordance with a force generated based on the pressure difference. The pressure in a control chamber (for example, the crank chamber of a swash plate type compressor) is adjusted according to the position of the valve body 102.

The pressure difference between the pressure monitoring points P1, P2 represents the flow rate of refrigerant in the refrigerant circuit. The pressure sensing member 101 determines the position of the valve body 102 such that the displacement of the compressor is changed to cancel the fluctuation of the pressure difference, or the fluctuation of the refrigerant flow rate in the refrigerant circuit.

The above described control valve has a simple internal self-control function for maintaining a predetermined single refrigerant flow rate. In other words, the control valve does not actively change the refrigerant flow rate, and therefore, cannot respond to subtle changes in demand for controlling the air conditioning.

SUMMARY OF THE INVENTION

Accordingly, it is an objective of the present invention to provide a control valve for a variable displacement compressor that accurately controls air conditioning.

To achieve the foregoing and other objectives and in accordance with the purpose of the present invention, a control valve used for a variable displacement compressor installed in a refrigerant circuit is provided. The compressor varies the displacement in accordance with the pressure in a control chamber. The compressor has a control passage, which connects the control chamber to a pressure zone in which the pressure is different from the pressure of the control chamber. The control valve includes a valve housing, a valve chamber defined in the valve housing, a valve body, a pressure sensing chamber defined in the valve housing, a pressure sensing member, a pressure sensing rod, a solenoid chamber, a movable iron core, a stationary iron core, a solenoid rod, and an electromagnetic actuator. The valve body is accommodated in the valve chamber for adjusting the opening degree of the control passage. The pressure sensing member divides the pressure sensing chamber into a first pressure chamber and a second pressure chamber. The pressure at a first pressure monitoring point in the refrigerant circuit is applied to the first pressure chamber. The pressure at a second pressure monitoring point in the refrigerant circuit, which is downstream of the first pressure monitoring point, is applied to the second pressure chamber. The pressure sensing rod is slidably supported by the valve housing between the valve chamber and the pressure sensing chamber. An end of the pressure sensing rod is connected to the pressure sensing member and the other end of the pressure sensing rod contacts the valve body. The pressure sensing member moves the valve body via the pressure sensing rod in accordance with the pressure difference between the first pressure chamber and the second pressure chamber such that the displacement of the compressor is varied to counter changes of the pressure difference. The solenoid chamber is defined in the valve housing to be adjacent to the valve chamber. The movable iron core is movably accommodated in the solenoid chamber. The stationary iron core is located between the valve chamber and the solenoid chamber. The stationary iron core separates the valve chamber from the solenoid chamber. The solenoid rod extends through and is slidably supported by the stationary iron core. The solenoid rod supports the valve body in the valve chamber and supports the movable iron core in the solenoid chamber. The electromagnetic actuator applies an urging force to the pressure sensing member in accordance with an external command. The electromagnetic actuator includes the movable iron core and the stationary iron core. The urging force applied to the pressure sensing member by the actuator corresponds to a target value of the pressure difference. The pressure sensing member moves the valve body such that the pressure difference seeks the target value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve according to a first embodiment of the present invention will now be described with reference to FIGS. 1 to 3. The control valve is used in a variable displacement swash plate type compressor located in a vehicle air conditioner.

Figure 1:
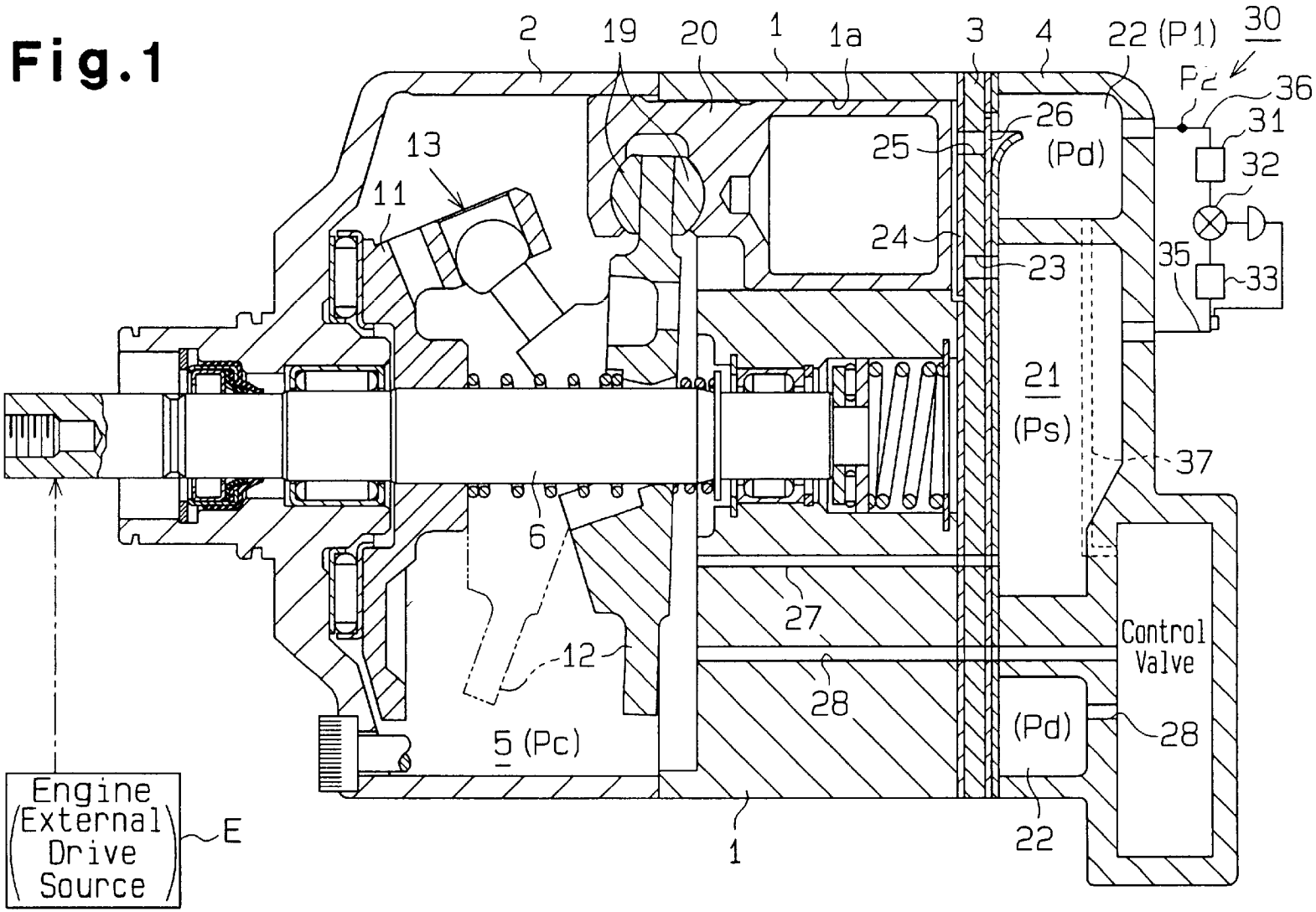
FIG. 1 is a cross-sectional view illustrating a swash plate type variable displacement compressor according to a first embodiment of the present invention.

As shown in FIG. 1, the compressor includes a cylinder block 1, a front housing member 2 connected to the front end of the cylinder block 1, and a rear housing member 4 connected to the rear end of the cylinder block 1. A valve plate assembly 3 is located between the rear housing member 4 and the cylinder block 1. The cylinder block 1, the front housing member 2, and the rear housing member 4 form the housing of the compressor.

A control chamber, which is a crank chamber 5 in this embodiment, is defined between the cylinder block 1 and the front housing member 2. A drive shaft 6 extends through the crank chamber 5 and is rotatably supported. The drive shaft 6 is connected to and driven by an external drive source, which is an engine E in this embodiment.

A lug plate 11 is fixed to the drive shaft 6 in the crank chamber 5 to rotate integrally with the drive shaft 6. A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The hinge mechanism 13 and the lug plate 11 cause the swash plate 12 to move integrally with the drive shaft 6.

Cylinder bores 1*a* (only one is shown in FIG. 1) are formed in the cylinder block 1 at constant angular intervals around the axis L of the drive shaft 6. Each cylinder bore 1*a* accommodates a single headed piston 20 such that the piston 20 can reciprocate in the cylinder bore 1*a*. The opening of each cylinder bore 1*a* is closed by the valve plate assembly 3 and the corresponding piston 20. A compression chamber, the volume of which varies in accordance with the reciprocation of the piston 20, is defined in each cylinder bore 1*a*. The front end of each piston 20 is coupled to the periphery of the swash plate 12 through a pair of shoes 19. The swash plate 12 is rotated as the drive shaft 6 rotates. Rotation of the swash plate 12 is converted into reciprocation of each piston 20 by the corresponding pair of shoes 19.

A suction chamber 21 and a discharge chamber 22 are defined between the valve plate assembly 3 and the rear housing member 4. The discharge chamber 22 is located about the suction chamber 21. The valve plate assembly 3 has suction ports 23, suction valve flaps 24, discharge ports 25, and discharge valve flaps 26. Each set of a suction port 23, a suction valve flap 24, a discharge port 25, and a discharge valve flap 26 corresponds to one of the cylinder bores 1*a*.

When each piston 20 moves from the top dead center position to the bottom dead center position, refrigerant gas in the suction chamber 21 flows into the corresponding cylinder bore 1*a* via the corresponding suction port 23 and suction valve flap 24. When each piston 20 moves from the bottom dead center position to the top dead center position, refrigerant gas in the corresponding cylinder bore 1*a* is compressed to a predetermined pressure and is discharged to the discharge chamber 22 via the corresponding discharge port 25 and discharge valve flap 26.

A mechanism for controlling the pressure in the crank chamber 5, or crank chamber pressure Pc, includes a bleed passage 27, a supply passage 28, and the control valve CV. The passages 27, 28 are formed in the housing. The bleed passage 27 connects a suction pressure zone Ps, or the suction chamber 21, with the crank chamber 5. The supply passage 28 connects a discharge pressure zone Pd, or the discharge chamber 22, with the crank chamber 5. The control valve CV is located in the supply passage 28.

The control valve CV changes the opening of the supply passage 28 to adjust the flow rate of refrigerant gas from the discharge chamber 22 to the crank chamber 5. The crank chamber pressure Pc is changed in accordance with the relationship between the flow rate of refrigerant gas flowing from the discharge chamber 22 to the crank chamber 5 and the flow rate of refrigerant gas flowing out from the crank chamber 5 to the suction chamber 21 through the bleed passage 27. The difference between the crank chamber pressure Pc and the pressure in the cylinder bores 1*a* is changed in accordance with the crank chamber pressure Pc, which varies the inclination angle of the swash plate 12. This alters the stroke of each piston 20 and the compressor displacement.

The refrigerant circuit of the vehicular air-conditioner is made up of the compressor and an external refrigerant circuit 30. The external refrigerant circuit 30 connects the discharge chamber 22 to the suction chamber 21, and includes a condenser 31, an expansion valve 32, and an evaporator 33. A downstream pipe 35 is located in a downstream portion of the external refrigerant circuit 30. The downstream pipe 35 connects the outlet of the evaporator 33 with the suction chamber 21 of the compressor. An upstream pipe 36 is located in the upstream portion of the external refrigerant circuit 30. The upstream pipe 36 connects the discharge chamber 22 of the compressor with the inlet of the condenser 31.

The greater the flow rate of the refrigerant flowing in the refrigerant circuit is, the greater the pressure loss per unit length of the circuit or piping is. That is, the pressure loss (pressure difference) between pressure monitoring points P1, P2 has a positive correlation with the flow rate of the refrigerant in the circuit. Detecting the pressure difference between the pressure monitoring points P1, P2 permits the flow rate of refrigerant in the refrigerant circuit to be indirectly detected. Hereinafter, the pressure difference between the pressure monitoring points P1, P2 will be referred to as pressure difference ΔPd.

Figure 2:
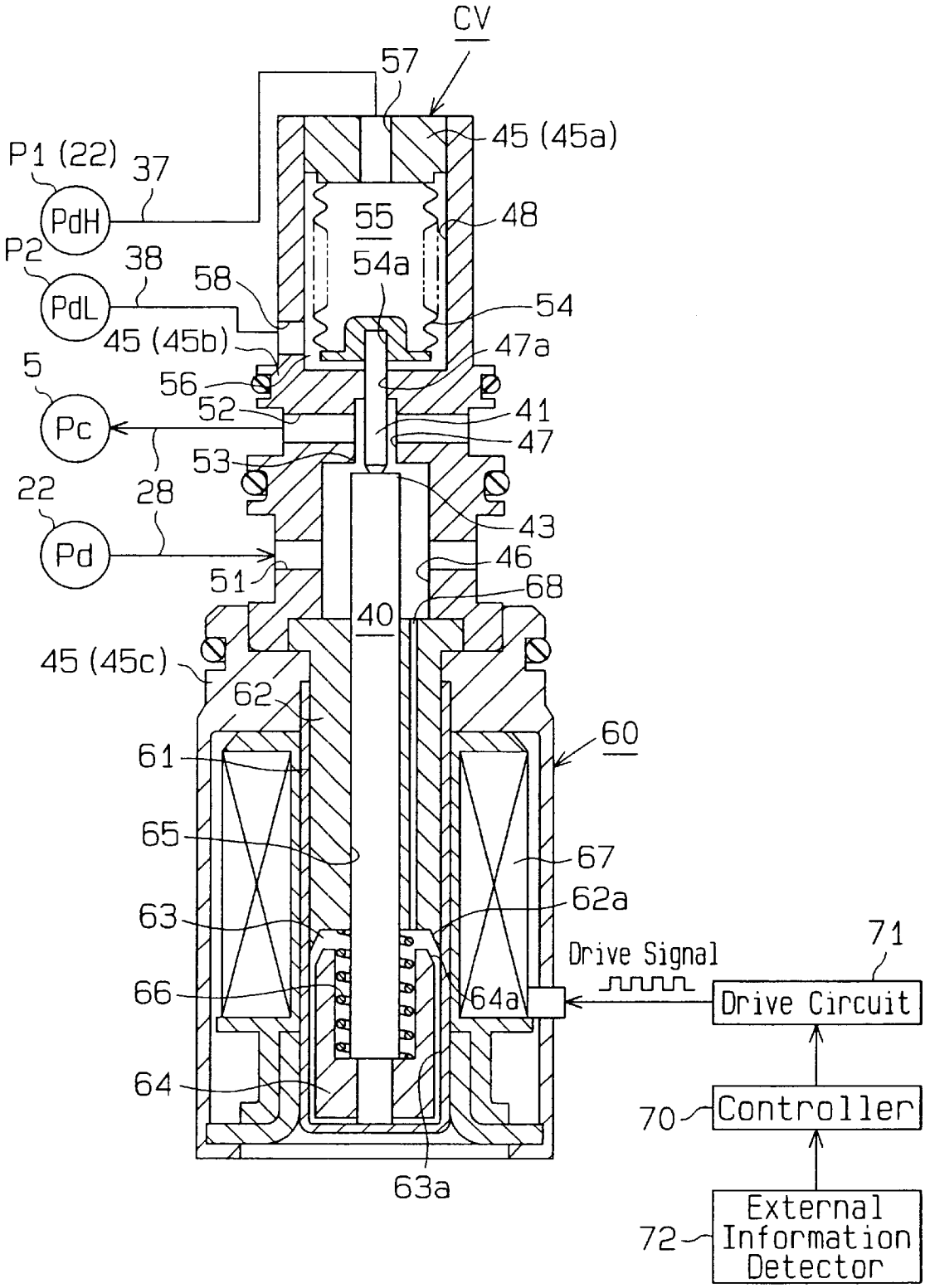
FIG. 2 is a cross-sectional view illustrating the control valve used in the compressor shown in FIG. 1.

As shown in FIG. 2, the first pressure monitoring point P1 is located in the discharge chamber 22, the pressure of which is equal to that of the most upstream section of the upstream pipe 36. The second pressure monitoring point P2 is set midway along the upstream pipe 36 at a position separated from the first pressure monitoring point P1 by a predetermined distance. The pressure PdH at the first pressure monitoring point P1 is applied to the displacement control valve CV through a first pressure introduction passage 37. The pressure PdL at the second pressure monitoring point P2 is applied to the displacement control valve CV through a second pressure introduction passage 38.

The control valve CV has a supply control valve portion and a solenoid 60. The supply control valve portion controls the opening (throttle amount) of the supply passage 28, which connects the discharge chamber 22 with the crank chamber 5. The solenoid 60 serves as an electromagnetic actuator for controlling a solenoid rod 40 located in the control valve CV on the basis of an externally supplied electric current. The solenoid rod 40 has a valve body 43 at the distal end.

A valve housing 45 of the control valve CV has a plug 45*a*, an upper half body 45*b*, and a lower half body 45*c*. A valve chamber 46 and a communication passage 47 are defined in the upper half body 45*b*. A pressure sensing chamber 48 is defined between the upper half body 45*b* and the plug 45*a*.

The solenoid rod 40 moves in the axial direction of the control valve CV in the valve chamber 46. The valve chamber 46 is selectively connected to and disconnected from the communication passage 47 in accordance with the position of the solenoid rod 40. A pressure sensing rod 41, which is separated from the solenoid rod 40, is located in the communication passage 47. The pressure sensing rod 41 moves in the axial direction of the control valve CV and is fitted in a small diameter portion 47*a* of the communication passage 47. The rod pressure sensing rod 41 disconnects the communication passage 47 from the pressure sensing chamber 48.

The upper end face of a stationary iron core 62, which will be discussed below, serves as the bottom wall of the valve chamber 46. A first valve port 51, extending radially from the valve chamber 46, connects the valve chamber 46 with the discharge chamber 22 through an upstream part of the supply passage 28. A second valve port 52, extending radially from the communication passage 47, connects the communication passage 47 with the crank chamber 5 through a downstream part of the supply passage 28. Thus, the first valve port 51, the valve chamber 46, the communication passage 47, and the second valve port 52 serve as part of the control passage, or the supply passage 28, which connects the discharge chamber 22 with the crank chamber 5.

The valve body portion 43 of the solenoid rod 40 is located in the valve chamber 46. The step between the valve chamber 46 and the communication passage 47 functions as a valve seat 53. When the solenoid rod 40 moves from the position of FIG. 2 (the lowest position) to the highest position, at which the valve body portion 43 contacts the valve seat 53, the communication passage 47 is isolated. That is, the valve body portion 43 functions as a valve body that selectively opens and closes the supply passage 28.

A pressure sensing member, which is a bellows 54 in this embodiment, is located in the pressure sensing chamber 48. The upper end of the bellows 54 is fixed to the plug 45*a* of the valve housing 45. The pressure sensing chamber 48 is divided into a first pressure chamber 55 and a second pressure chamber 56 by the bellows 54.

A rod seat 54*a* is located at the lower end of the bellows 54. The upper end of the pressure sensing rod 41 is located in the rod seat 54*a*. The bellows 54 is installed in an elastically deformed state. The bellows 54 urges the pressure sensing rod 41 downward through the rod seat 54*a* by the downward force generated by the elastic deformation. Therefore, the lower end of the pressure sensing rod 41 is pressed against the upper end of the solenoid rod 40 by the force of the bellows 54. The pressure sensing rod 41 moves integrally with the solenoid rod 40.

The first pressure chamber 55 is connected to the first pressure monitoring point P1, which is the discharge chamber 22, through a P1 port 57 formed in the plug 45*a*, and the first pressure introduction passage 37. The second pressure chamber 56 is connected to the second pressure monitoring point P2 through a P2 port 58, which is formed in the upper half body 45*b* of the valve housing 45, and the second pressure introduction passage 38. Therefore, the first pressure chamber 55 is exposed to the pressure PdH monitored at the first pressure monitoring point P1, and the second pressure chamber 56 is exposed to the pressure PdL monitored at the second pressure monitoring point P2.

The solenoid 60 includes an accommodating cup 61. The stationary iron core 62 is fitted in the upper part of the accommodating cup 61. A solenoid chamber 63 is defined in the accommodating cup 61. A movable iron core 64 is accommodated in the solenoid chamber 63 to move along the axis of the valve housing 45. The movable iron core 64 is formed like a cylindrical column. The outer diameter of the movable iron core 64 is smaller than the diameter of the inner surface 63*a* of the solenoid chamber 63 (the accommodating cup 61).

An axially extending guide hole 65 is formed in the central portion of the stationary iron core 62. The solenoid rod 40 is located to move axially in the guide hole 65. The lower end of the solenoid rod 40 is secured to the movable iron core 64 in the solenoid chamber 63. Therefore, the movable iron core 64 is supported by the guide hole 65 (the stationary iron core 62) through the solenoid rod 40, and moves integrally with the solenoid rod 40. That is, displacement of the movable iron core 64 is guided by the guide hole 65 (the stationary iron core 62) through the solenoid rod 40.

An annular projection 62*a* having an inclined surface is formed at an end portion (the bottom) of the stationary iron core 62 about the axis of the valve housing 45. An annular chamfer 64*a* is formed at the upper end of the movable iron core 64 to form a peripheral portion of the movable iron core that faces the inclined surface. The shape of the chamfer 64*a* is determined to match the inner surface of the annular projection 62*a*. This structure permits electromagnetic attraction force generated between the stationary iron core 62 and the movable iron core 64 to be accurately controlled according to the distance between the cores 62 and 64. The electromagnetic force will be discussed later.

A pressure passage 68 is formed in the stationary iron core 62 for connecting the valve chamber 46 with the solenoid chamber 63. The solenoid chamber 63 is exposed to the discharge pressure Pd of the valve chamber 46 through the pressure passage 68. In the solenoid chamber 63, spaces at the axial sides of the movable iron core 64 are exposed to the discharge pressure Pd through the clearance between the inner surface 63*a* of the solenoid chamber 63 and the movable iron core 64. Although not discussed in detail, exposing the solenoid chamber 63 to the discharge pressure Pd permits the position of the solenoid rod 40, or the opening degree of the control valve CV, to be accurately controlled.

In the solenoid chamber 63, a coil spring 66 is located between the stationary iron core 62 and the movable iron core 64. The spring 66 urges the movable iron core 64 downward, or away from the stationary iron core 62.

A coil 67 is wound about the stationary iron core 62 and the movable iron core 64. The coil 67 is connected to a drive circuit 71, and the drive circuit 71 is connected to a controller 70. The controller 70 is connected to an external information detector 72. The controller 70 receives external information (on-off state of the air conditioner, the temperature of the passenger compartment, and a target temperature) from the detector 72. Based on the received information, the controller 70 commands the drive circuit 71 to supply a drive signal to the coil 67. The coil 67 generates an electromagnetic force, the magnitude of which depends on the value of the supplied current, between the stationary iron core 62 and the movable iron core 64. The value of the current supplied to the coil 67 is controlled by controlling the voltage applied to the coil 67. In this embodiment, the applied voltage is controlled by pulse-width modulation.

The opening degree of the control valve CV is determined by the position of the solenoid rod 40.

When no current is supplied to the coil 67 (duty ratio= 0%), the downward force of the bellows 54 and the spring 66 is dominant in determining the position of the solenoid rod 40. As a result, the solenoid rod 40 is moved to its lowermost position shown in FIG. 2 and causes the valve body 43 to fully open the communication passage 47. Accordingly, the crank chamber pressure Pc is maximized. Therefore, the difference between the crank chamber pressure Pc and the pressure in the cylinder bores 1*a* is increased, which minimizes the inclination angle of the swash plate 12 and the compressor displacement.

When the electric current corresponding to the minimum duty ratio (duty ratio>0%) within the range of duty ratios is supplied to the coil 67, the upward electromagnetic force exceeds the downward force of the bellows 54 and the spring 66, and the solenoid rod 40 moves upward. In this state, the resultant of the upward electromagnetic force and the downward force of the spring 66 acts against the resultant of the forces of the bellows 54 and the force based on the pressure difference between the pressure monitoring points P1, P2

(ΔPd=PdH−PdL). The position of the valve body 43 of the solenoid rod 40 relative to the valve seat 53 is determined such that upward and downward forces are balanced.

When the speed of the engine E is lowered, the flow rate in the refrigerant circuit is decreased. At this time, the downward force based on the pressure difference ΔPd is decreased and the solenoid rod 40 (the valve body 43) moves upward, which decreases the opening of the communication passage 47. The crank chamber pressure Pc is decreased accordingly. This increases the inclination angle of the swash plate 12 and the compressor displacement. When the compressor displacement is increased, the pressure difference ΔPd is increased.

When the speed of the engine E is increased, the flow rate in the refrigerant circuit is increased. At this time, the downward force based on the pressure difference ΔPd is increased and the solenoid rod 40 (the valve body 43) moves downward, which increases the opening of the communication passage 47. The crank chamber pressure Pc is increased accordingly. This decreases the inclination angle of the swash plate 12 and the compressor displacement. When the compressor displacement is decreased, the flow rate in the refrigerant circuit is decreased and the pressure difference ΔPd is decreased.

If the duty ratio to the coil 67 is increased to increase the upward electromagnetic force, the solenoid rod 40 moves upward and the opening degree of the communication passage 47 is decreased. As a result, the compressor displacement is increased, the flow rate in the refrigerant circuit is increased and the pressure difference ΔPd is increased.

If the duty ratio to the coil 67 is decreased to decrease the upward electromagnetic force, the solenoid rod 40 moves downward and the opening degree of the communication passage 47 is increased. As a result, the compressor displacement is decreased, the flow rate in the refrigerant circuit is decreased and the pressure difference ΔPd is decreased.

As described above, the target value of the pressure difference ΔPd is determined by the duty ratio supplied to the coil 67. The control valve CV automatically determines the position of the solenoid rod 40 according to changes of the pressure difference ΔPd to maintain the pressure difference ΔPd to the target value. The target value of the pressure difference ΔPd is changed by adjusting the duty ratio to the coil 67.

The embodiment of FIGS. 1 and 2 has the following advantages.

The pressure difference ΔPd that is a reference for adjusting the opening degree of the control valve CV is changed by changing the duty ratio supplied to the coil 67. Therefore, the control valve CV can perform more delicate control compared with a control valve that has no electromagnetic actuator (solenoid 60), and has only a single target pressure difference.

Figure 3:
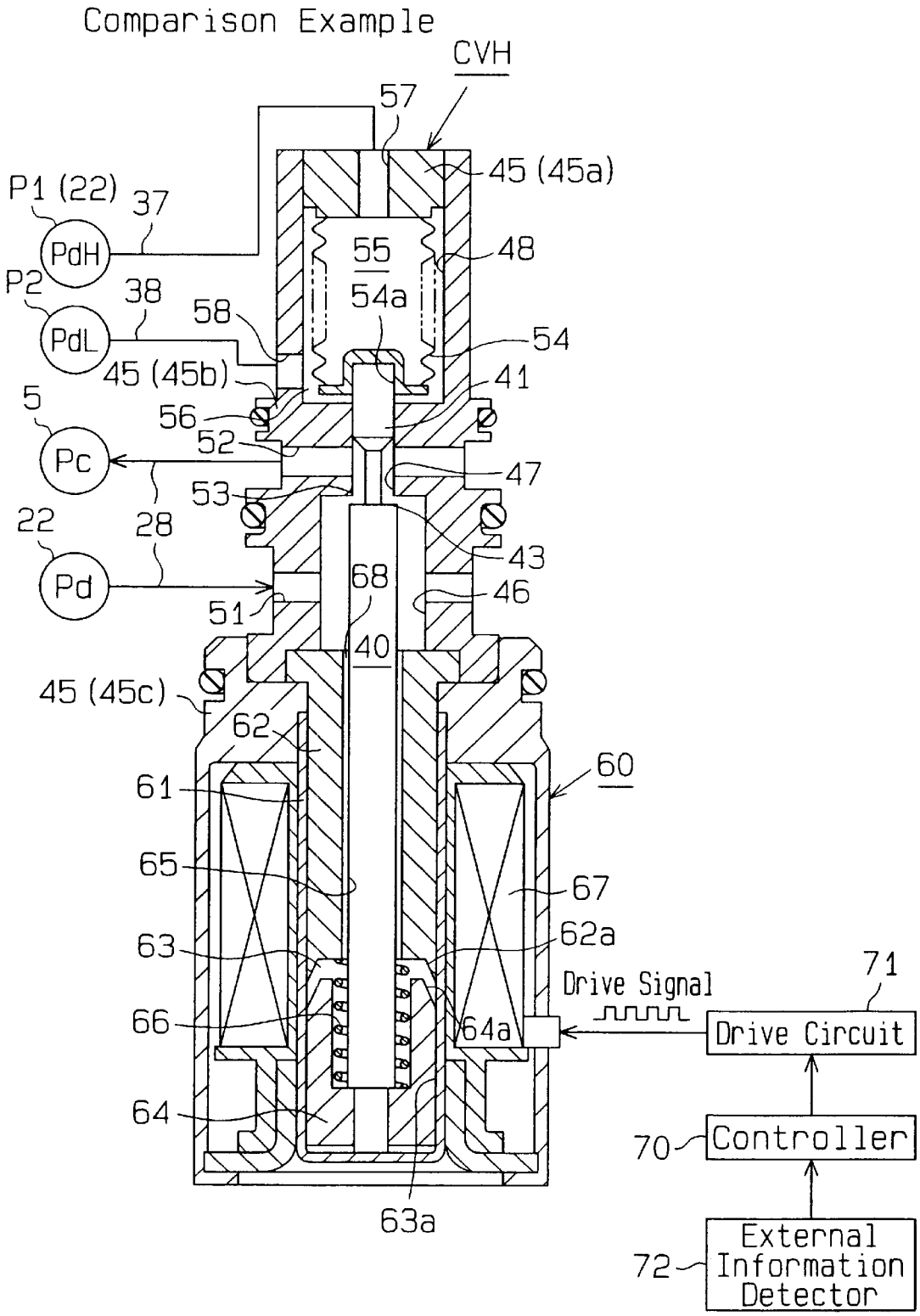
FIG. 3 is a cross-sectional view illustrating a control valve of a comparison example.

FIG. 3 shows a control valve CVH of a comparison example. The example control valve CVH is the same as the control valve CV except for the following three points. First, the pressure sensing rod 41 is fixed to the solenoid rod 40. Second, the pressure passage 68 is replaced by the clearance between the guide hole 65 and the solenoid rod 40. Lastly, the diameter of the inner surface 63*a* of the solenoid chamber 63 is substantially equal to the outer diameter of the movable iron core 64, and the movable iron core 64 is slidably supported by the inner surface 63*a*. That is, the pressure sensing rod 41, the solenoid rod 40, and the movable iron core 64 are slidably supported by the valve housing 45 at the contacting parts of the pressure sensing rod 41 and the communication passage 47, and at the contacting parts of the movable iron core 64 and the inner surface 63*a* of the solenoid chamber 63.

As described above, the solenoid rod 40, the pressure sensing rod 41, and the movable iron core 64 form an integral member, which is supported at two locations in the valve housing 45. Improving the machining accuracy of one of the supported portions, or eliminating chattering, prevents errors at the other supported portion from being absorbed. Therefore, assembly of the integral member to the valve housing 45 is difficult.

Consequently, the machining accuracy at the supported portions cannot be sufficiently improved. This significantly displaces the axis of the stationary iron core 62 from the axis of the movable iron core 64. Accordingly, the space between the cores 62, 64 is reduced at one side. In this state, the electromagnetic force acts to move the movable iron core 64 radially such that the already reduced space is further reduced. In other words, the movable iron core 64 is moved in a direction perpendicular to its axis. This increases the friction at the supported portions, and creates hysteresis in the control valve CVH.

In contrast with the control valve CVH, the solenoid rod 40 (the valve body 43 and the pressure sensing rod 41) of the control valve CV is separately formed from the pressure sensing rod 41. Therefore, the solenoid rod 40 (the valve body 43) may be moved relative to each other in directions perpendicular to the axis of the valve housing 45. Therefore, even if electromagnetic force between the movable iron core 64 and the stationary iron core 62 moves the solenoid rod 40 in a direction perpendicular to the axis of the valve housing 45, the movement of the solenoid rod 40 is not transmitted to the pressure sensing rod 41. This decreases the friction acting on the pressure sensing rod 41. As a result, hysteresis is prevented in the control valve CV.

The movable iron core 64 of the control valve CV is moved integrally with the solenoid rod 40, which slides along the guide hole 65 formed in the stationary iron core 62. That is, the integral member having the solenoid rod 40 and the movable iron core 64 is supported at one location, or at the guide hole 65. Therefore, improving the machining accuracy of the guide hole 65 and the solenoid rod 40 does not cause the assembly of the integral member to the housing 45 to be difficult. As a result, the position of the movable iron core 64 is accurately determined while the axis of the movable iron core 64 is aligned with the axis of the stationary iron core 62. Therefore, lateral force applied to the solenoid rod 40 is reduced. As a result, hysteresis of the control valve CV is further reduced.

It should be apparent to those skilled in the art that the present invention may be embodied in many other specific forms without departing from the spirit or scope of the invention. Particularly, it should be understood that the invention may be embodied in the following forms.

Figure 4:
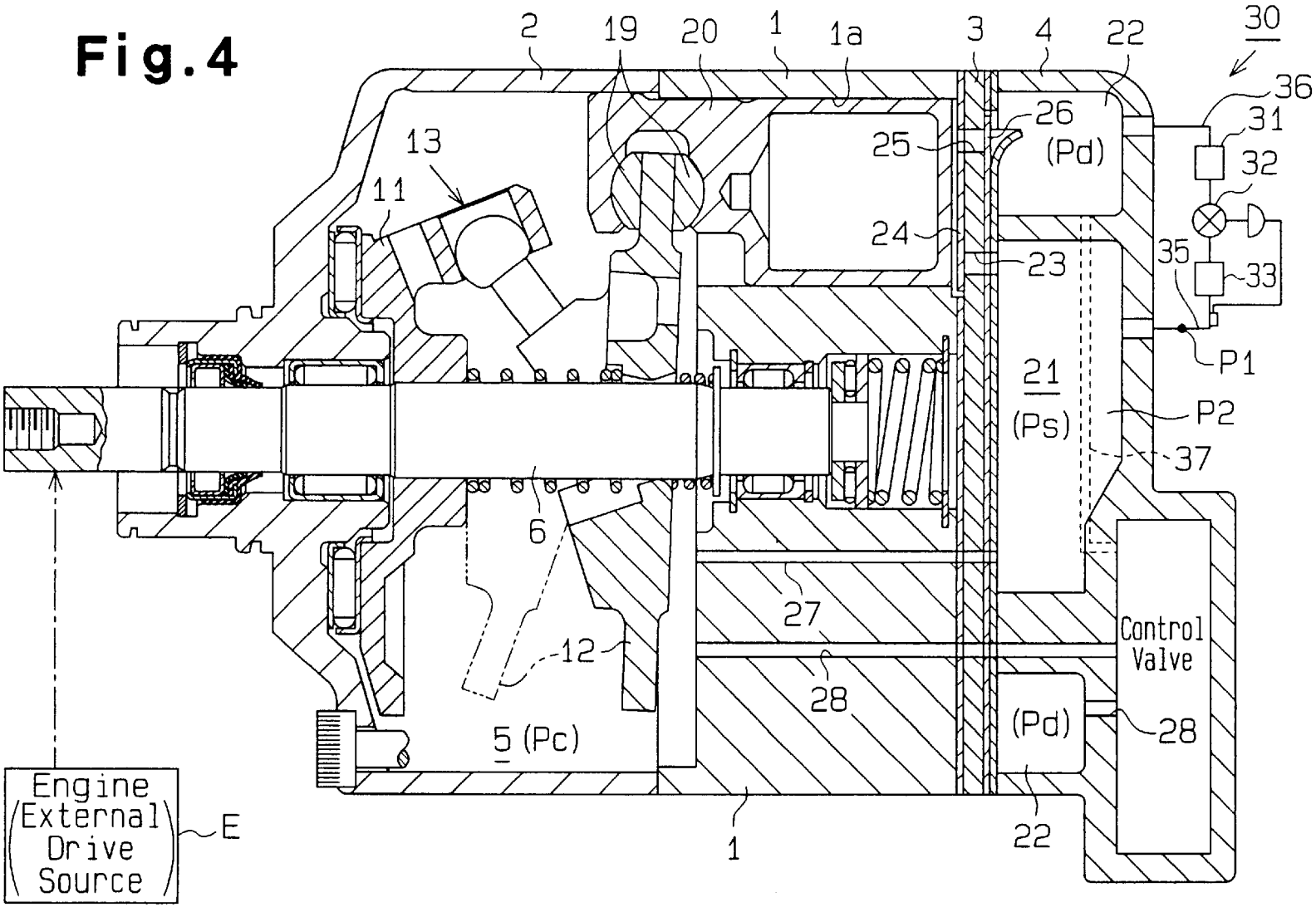
FIG. 4 is a cross-sectional view illustrating a compressor according to a second embodiment of the present invention.
Figure 5:
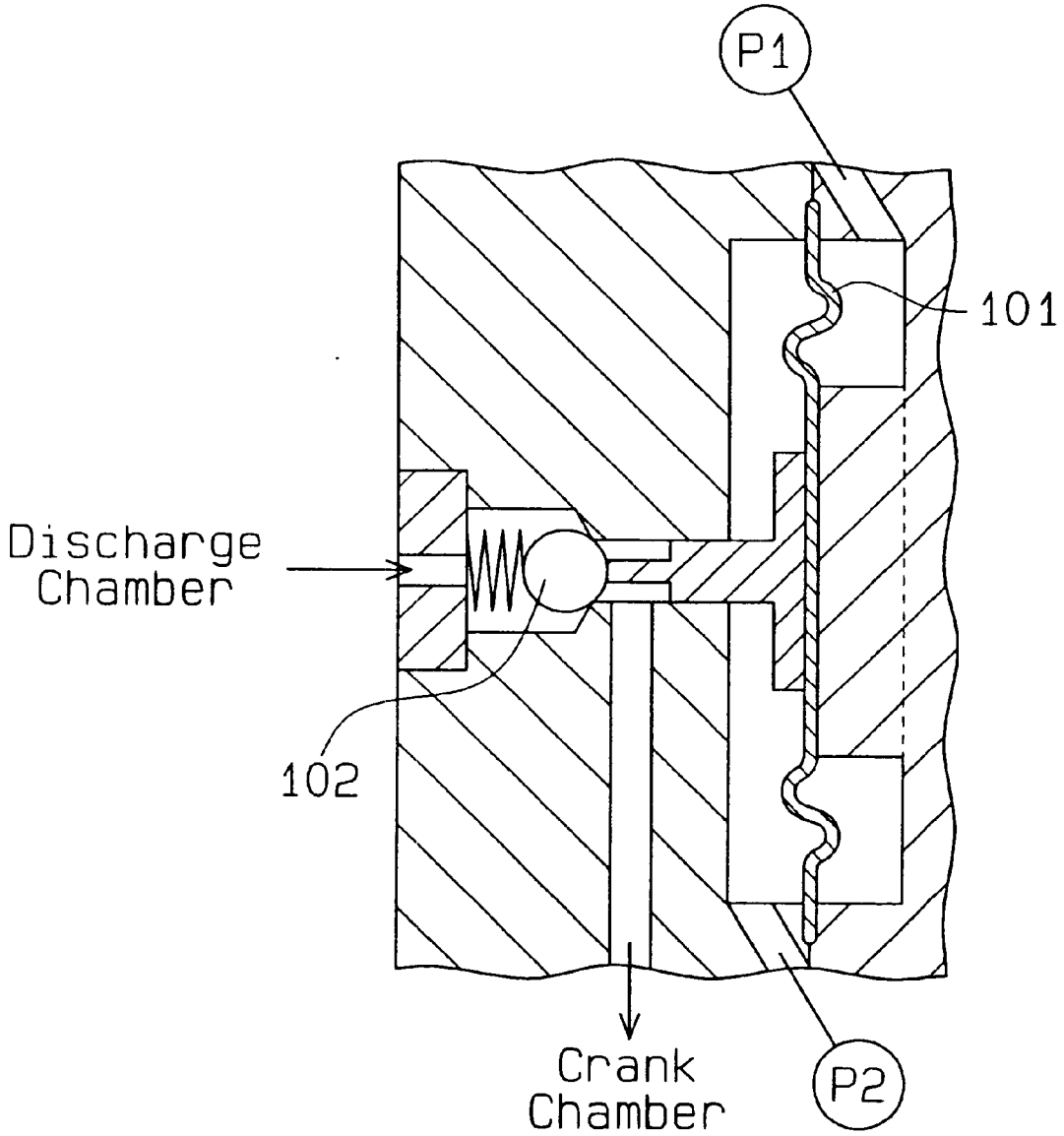
Fig.5(Prior Art)
FIG. 5 is a cross-sectional view illustrating a prior art control valve.

FIG. 4 illustrates a second embodiment of the present invention. The second embodiment is a modification of the first embodiment. In the second embodiment, the first pressure monitoring point P1 is located in the suction pressure zone Ps, which includes the evaporator 33 and the suction chamber 21. Specifically, the first pressure monitoring point P1 is located in the downstream pipe 35. The second pressure monitoring point P2 is also located in the suction pressure zone Ps and downstream of the first pressure monitoring point P1. Specifically, the second pressure monitoring point P2 is located in the suction chamber 21.

The first pressure monitoring point P1 may be located in the discharge pressure zone Pd, which includes the discharge chamber 22 and the condenser 31, and the second pressure monitoring point P2 may be located in the suction pressure zone Ps, which includes the evaporator 33 and the suction chamber 21.

The first pressure monitoring point P1 may be located in the discharge pressure zone Pd, which includes the discharge chamber 22 and the condenser 31, and the second pressure monitoring point P2 may be located in the crank chamber 5.

In the pressure sensing chamber 48 shown in FIG. 2, the interior of the bellows 54 may function as the second pressure chamber 56, and the space outside of the bellows 54 may function as the first pressure chamber 55. In this case, the first pressure monitoring point P1 is located in the crank chamber 5, and the second pressure monitoring point P2 is located in the suction pressure zone Ps, which includes the evaporator 33 and the suction chamber 21.

The locations of the pressure monitoring points P1 and P2 are not limited to the main circuit of the refrigerant circuit, which includes the evaporator 33, the suction chamber 21, the cylinder bores 1*a*, the discharge chamber 22, and the condenser 31. That is, the pressure monitoring points P1 and P2 need not be in a high pressure zone or a low pressure zone of the refrigerant circuit. For example, the pressure monitoring points P1, P2 may be located in the crank chamber 5, which is an intermediate pressure zone of a refrigerant passage for controlling the compressor displacement. The displacement controlling passage is a sub-circuit of the refrigerant circuit, and includes the supply passage 28, the crank chamber 5, and the bleed passage 27.

In the control valve CV shown in FIG. 2, the valve chamber 46 may be connected to the crank chamber 5 through a downstream section of the supply passage 28, and the communication passage 47 may be connected to the discharge chamber 22 through an upstream section of the supply passage 28. In this case, the pressure difference between the second pressure chamber 56 and the communication passage 47, which is adjacent to the second pressure chamber 56, is decreased. This prevents refrigerant from leaking between the communication passage 47 and the second pressure chamber 56 and thus permits the compressor displacement to be accurately controlled.

The control valve CV may be used as a bleed control valve for controlling the crank chamber pressure Pc by controlling the opening of the bleed passage 27.

The present invention may be embodied in a control valve of a wobble type variable displacement compressor.

In the illustrated embodiments of FIGS. 1 to 4, the swash plate 12 may be coupled to a fluid pressure actuator. In this case, the high pressure section of the bleed passage 27 and the low pressure section of the supply passage 28 are connected to a pressure chamber of the actuator. The control valve CV controls the pressure in the pressure chamber of the actuator thereby changing the inclination angle of the swash plate 12.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor installed in a refrigerant circuit, wherein the compressor has a discharge pressure zone, a suction pressure zone, and a crank pressure zone, wherein the compressor varies the displacement in accordance with the pressure in a control chamber, wherein the compressor has a control passage, which connects the control chamber to a pressure zone in which the pressure is different from the pressure of the control chamber, the control valve comprising:

a valve housing;

a valve chamber defined in the valve housing;

a valve body, which is accommodated in the valve chamber for adjusting the opening degree of the control passage;

a pressure sensing chamber defined in the valve housing;

a pressure sensing member, which divides the pressure sensing chamber into a first pressure chamber and a second pressure chamber, wherein the pressure at a first pressure monitoring point in any one of the discharge pressure zone, the suction pressure zone, and the crank pressure zone is applied to the first pressure chamber, wherein the pressure at a second pressure monitoring point in any one of the discharge pressure zone, the suction pressure zone, and the crank pressure zone, which is downstream of the first pressure monitoring point, is applied to the second pressure chamber;

a pressure sensing rod slidably supported by the valve housing between the valve chamber and the pressure sensing chamber, wherein an end of the pressure sensing rod is connected to the pressure sensing member and the other end of the pressure sensing rod contacts the valve body, wherein the pressure sensing member moves the valve body via the pressure sensing rod in accordance with the pressure difference between the first pressure chamber and the second pressure chamber such that the displacement of the compressor is varied to counter changes of the pressure difference;

a solenoid chamber defined in the valve housing to be adjacent to the valve chamber;

a movable iron core movably accommodated in the solenoid chamber;

a stationary iron core located between the valve chamber and the solenoid chamber, wherein the stationary iron core separates the valve chamber from the solenoid chamber;

a solenoid rod, which extends through and is slidably supported by the stationary iron core, wherein the solenoid rod supports the valve body in the valve chamber and supports the movable iron core in the solenoid chamber; and an electromagnetic actuator for applying an urging force to the pressure sensing member in accordance with an external command, wherein the electromagnetic actuator includes the movable iron core and the stationary iron core, wherein the urging force applied to the pressure sensing member by the actuator corresponds to a target value of the pressure difference, and wherein the pressure sensing member moves the valve body such that the pressure difference seeks the target value.

2. The control valve according to claim 1, wherein the movable iron core is guided only by the stationary iron core via the solenoid rod.

3. The control valve according to claim 1, wherein the first and second pressure monitoring points are located in the discharge pressure zone.

4. The control valve according to claim 3, wherein the control passage is a supply passage, which connects the control chamber to the discharge pressure zone, wherein the valve chamber forms a part of the supply passage, wherein the control valve has a communication passage, the opening degree of which is adjusted by the valve body, and wherein the valve chamber is connected to the discharge pressure zone via the communication passage.

5. The control valve according to claim 1, wherein the first and second pressure monitoring points are located in the suction pressure zone.

6. The control valve according to claim 1, wherein an inclined surface is formed on an end portion of the stationary iron core, wherein the inclined surface is inclined with respect to an axis of the stationary iron core, wherein a peripheral portion of the movable iron core faces the inclined surface, and wherein the peripheral portion as chamfered to match the inclined surface.

7. A control valve used for a variable displacement compressor installed in a refrigerant circuit of an air conditioner, wherein the compressor has a discharge pressure zone, a suction pressure zone, and a crank pressure zone, wherein the compressor varies the displacement in accordance with the pressure in a control chamber, wherein the compressor has a control passage, which connects the control chamber to a pressure zone in which the pressure is different from the pressure of the control chamber, the control valve comprising:

a valve housing;

a valve chamber defined in the valve housing;

a valve body, which is accommodated in the valve chamber for adjusting the opening degree of the control passage;

a pressure sensing chamber defined in the valve housing;

a pressure sensing member, which divides the pressure sensing chamber into a first pressure chamber and a second pressure chamber, wherein the pressure at a first pressure monitoring point in any one of the discharge pressure zone, the suction pressure zone, and the crank pressure zone is applied to the first pressure chamber, wherein the pressure at a second pressure monitoring point in any one of the discharge pressure zone, the suction pressure zone, and the crank pressure zone, which is downstream of the first pressure monitoring point, is applied to the second pressure chamber;

a pressure sensing rod slidably supported by the valve housing between the valve chamber and the pressure sensing chamber, wherein an end of the pressure sensing rod is connected to the pressure sensing member and the other end of the pressure sensing rod contacts the valve body, wherein the pressure sensing member moves the valve body via the pressure sensing rod in accordance with the pressure difference between the first pressure chamber and the second pressure chamber such that the displacement of the compressor is varied to counter changes of the pressure difference;

a solenoid chamber defined in the valve housing to be adjacent to the valve chamber;

a movable iron core movably accommodated in the solenoid chamber;

a stationary iron core located between the valve chamber and the solenoid chamber, wherein the stationary iron core separates the valve chamber from the solenoid chamber;

a solenoid rod, which extends through and is slidably supported by the stationary iron core, wherein the solenoid rod supports the valve body in the valve chamber and supports the movable iron core in the solenoid chamber, wherein the solenoid rod moves relative to the pressure sensing rod in directions perpendicular to an axis of the valve housing; and an electromagnetic actuator for applying an urging force to the solenoid rod to move the pressure sensing member in accordance with an external command, wherein the electromagnetic actuator includes the movable iron core and the stationary iron core, wherein the urging force applied to the pressure sensing member through the solenoid rod by the actuator corresponds to a target value of the pressure difference, and wherein the pressure sensing member moves the valve body such that the pressure difference seeks the target value.

8. The control valve according to claim 7, wherein the movable iron core is guided only by the stationary iron core via the solenoid rod.

9. The control valve according to claim 7, wherein the first and second pressure monitoring points are located in the discharge pressure zone.

10. The control valve according to claim 9, wherein the control passage is a supply passage, which connects the control chamber to the discharge pressure zone, wherein the valve chamber forms a part of the supply passage, wherein the control valve has a communication passage, the opening degree of which is adjusted by the valve body, and wherein the valve chamber is connected to the discharge pressure zone via the communication passage.

11. The control valve according to claim 7, wherein the first and second pressure monitoring points are located in the suction pressure zone.

12. The control valve according to claim 7, wherein an inclined surface is formed on an end portion of the stationary iron core, wherein the inclined surface is inclined with respect to an axis of the stationary iron core, wherein a peripheral portion of the movable iron core faces to the inclined surface, and wherein the peripheral portion is chamfered to match the inclined surface.

* * * * *